US007699311B2

(12) United States Patent
Serizawa et al.

(10) Patent No.: US 7,699,311 B2
(45) Date of Patent: Apr. 20, 2010

(54) SHEET DISCRIMINATING APPARATUS AND IMAGE FORMING APPARATUS

(75) Inventors: Masahiro Serizawa, Toride (JP); Hidehiko Kinoshita, Kashiwa (JP); Hitoshi Kato, Toride (JP); Katsuyuki Yamazaki, Toride (JP); Kenji Morita, Toride (JP); Yuichi Yamamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 11/391,421

(22) Filed: Mar. 29, 2006

(65) Prior Publication Data

US 2006/0220305 A1 Oct. 5, 2006

(30) Foreign Application Priority Data

Apr. 1, 2005 (JP) ..... 2005-106928

(51) Int. Cl.
*B65H 7/02* (2006.01)

(52) U.S. Cl. ..... 271/265.04; 271/265.01

(58) Field of Classification Search ..... 271/265.04, 271/265.01, 262, 146
See application file for complete search history.

(56) References Cited

U.S. PATENT DOCUMENTS

| | | | | | |
|---|---|---|---|---|---|
| 4,550,252 | A * | 10/1985 | Tee | 250/223 R |
| 5,029,837 | A * | 7/1991 | Uchiyama | 271/110 |
| 5,525,809 | A * | 6/1996 | Bolea | 250/559.27 |
| 5,743,521 | A * | 4/1998 | Munakata et al. | 271/263 |
| 6,000,693 | A * | 12/1999 | Tranquilla | 271/263 |
| 6,375,180 | B1 * | 4/2002 | Kawano et al. | 270/58.09 |
| 6,734,417 | B2 * | 5/2004 | Vejtasa | 250/231.13 |
| 6,866,263 | B2 * | 3/2005 | Kawasaki | 271/262 |
| 7,255,343 | B2 * | 8/2007 | So | 271/262 |
| 2003/0006550 | A1 * | 1/2003 | Chujo et al. | 271/262 |
| 2003/0094748 | A1 * | 5/2003 | Chujo et al. | 271/262 |
| 2004/0070142 | A1 * | 4/2004 | Kawasaki | 271/262 |
| 2005/0189710 | A1 * | 9/2005 | Gemma | 271/265.01 |
| 2005/0280205 | A1 * | 12/2005 | Knierim | 271/265.04 |

FOREIGN PATENT DOCUMENTS

| | | | |
|---|---|---|---|
| JP | 5-8900 | | 1/1993 |
| JP | 09110252 | * | 4/1997 |
| JP | 09110252 A | * | 4/1997 |
| JP | 10-213581 | | 8/1998 |
| JP | 10213581 A | * | 8/1998 |
| JP | 2001-233500 | | 8/2001 |
| JP | 2007308246 | * | 11/2007 |
| JP | 2007308246 A | * | 11/2007 |

* cited by examiner

*Primary Examiner*—Patrick H Mackey
*Assistant Examiner*—Patrick Cicchino
(74) *Attorney, Agent, or Firm*—Fitzpatrick, Cella, Harper & Scinto

(57) ABSTRACT

A sheet discriminating apparatus includes a pair of conveying rotary members for conveying a sheet while rotating with the sheet sandwiched between the pair of conveying rotary members, a vibration detecting sensor for detecting vibrations of the pair of conveying rotary members. The sheet discriminating portion further includes a discriminating portion for making a discrimination in a type of the sheet based on the vibrations detected by the vibration detecting sensor.

8 Claims, 7 Drawing Sheets

SHEET DISCRIMINATING APPARATUS AND IMAGE FORMING APPARATUS

BACKGROUND OF THE INVENTION

1. Field of the Invention

The present invention relates to a sheet discriminating apparatus for discriminating a sheet type while conveying a sheet, and to an image forming apparatus for forming an image on a sheet which is equipped with the sheet discriminating apparatus.

2. Related Background Art

In a copying machine, a printer, or the like, an electrophotographic image forming apparatus is generally employed. This image forming apparatus transfers a toner image formed on a photosensitive drum or an intermediate transfer member, serving as an image carrier, onto a sheet which is transferred by a pair of rollers as a pair of conveying rotary members. The image forming apparatus heats and pressurizes the sheet by a fixing device to fix the toner image onto the sheet.

It is preferable to fix the toner image onto the sheet with a minimum amount of energy without reducing a degree of fixation of the toner image. However, there is a certain tolerance in heating temperature due to a difference in surface smoothness of the sheet, a difference in thickness of the sheet, and the like. Therefore, the toner image is fixed onto the sheet with low energy efficiency.

In view of the above, there is known an image forming apparatus equipped with a sheet discriminating apparatus for automatically making a discrimination of sheet type (see JP 2001-233500 A). This image forming apparatus forms an image on a sheet after having changed an image forming condition in accordance with a type of the sheet in which a discrimination has been made by the sheet discriminating apparatus.

This sheet discriminating apparatus has an acceleration sensor serving as vibration detecting means, which is provided close to an upstream side of a nip between a photosensitive drum on which a toner image is formed and a transfer roller (or an intermediate transfer roller) for transferring the toner image from the photosensitive drum onto a sheet. The sheet discriminating apparatus detects vibrations of the sheet sent into the nip by the acceleration sensor when the sheet passes after having come into contact with the acceleration sensor, thereby making a discrimination in a type of the sheet.

However, when the sheet is sent into the nip between the photosensitive drum and the transfer roller, it may bend toward or away from the acceleration sensor. Thus, the pressure of contact with the acceleration sensor differs depending on the bending direction of the sheet, so the acceleration sensor may not always be able to detect vibrations of the sheet under a definite condition.

SUMMARY OF THE INVENTION

It is an object of the present invention to reliably discriminate a sheet type.

A sheet discriminating apparatus according to the present invention includes:

a pair of conveying rotary members for conveying a sheet while rotating with the sheet sandwiched between the pair of conveying rotary members; a vibration detecting sensor for detecting vibrations of the pair of conveying rotary members; and a discriminating portion for making a discrimination in a thickness of the sheet based on the vibrations detected by the vibration detecting sensor, wherein the discriminating portion makes a discrimination in the thickness of the sheet based on vibrations of the pair of conveying rotary members which are detected by the vibration detecting sensor when a rear end of the sheet passes through the pair of conveying rotary members.

By detecting vibrations of the pair of conveying rotary members, a discrimination in sheet thickness can be made more reliably.

DESCRIPTION OF THE PREFERRED EMBODIMENTS

A sheet discriminating apparatus according to an embodiment of the present invention and an image forming apparatus equipped with the sheet discriminating apparatus will be described hereinafter with reference to the drawings.

Figure 1:
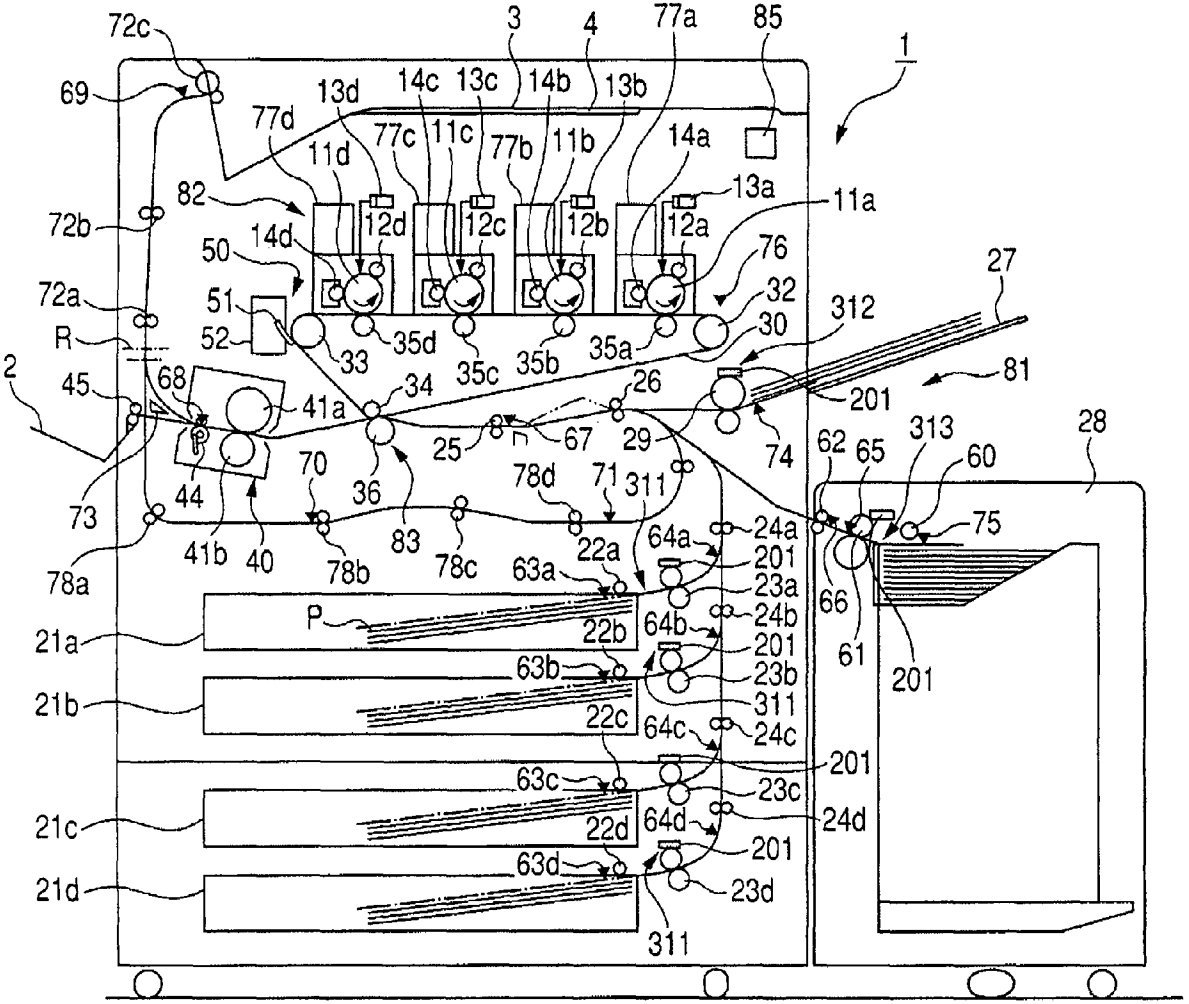
FIG. 1 is a sectional view of a color copying machine as an image forming apparatus taken along a sheet conveying direction.

FIG. 1 is a sectional view of a color copying machine as an image forming apparatus taken along a sheet conveying direction.

Image forming apparatuses for forming images on sheets include a copying machine, a printer, a facsimile machine, a multifunction machine for performing functions of these machines, and the like. Although the image forming apparatus according to this embodiment will be described based on an example of a color copying machine, the present invention should not be limited thereto.

A color copying machine 1 is composed of a sheet feed portion 81, a sheet discriminating apparatus 311, an image forming portion 82, an operational portion 4, a control unit 85, and the like.

A construction of the image forming portion 82 will be described. Photosensitive drums 11*a*, 11*b*, 11*c*, and 11*d* each pivoted at centers thereof, are rotated in directions indicated by arrows respectively by drive motors (not shown). Roller charging devices 12*a*, 12*b*, 12*c*, and 12*d*, scanners 13*a*, 13*b*, 13*c*, and 13*d*, and developing devices 14*a*, 14*b*, 14*c*, and 14*d* are respectively disposed in the stated order in the respective rotational directions of the photosensitive drums 11*a* to 11*d*, while facing outer peripheral surfaces thereof respectively.

In the following description, the photosensitive drums, the roller charging devices, the scanners, and the developing devices will be denoted by reference symbols "11", "12", "13", and "14" respectively, unless a specific one of them is described.

The image forming portion 82 has an intermediate transfer unit 83 as a transfer portion. An intermediate transfer belt 30 of the intermediate transfer unit 83 is made of, for example, polyethylene terephthalate (PET), polyvinylidene fluoride (PVdF), or the like. A driving roller 32 transmits a driving force to the intermediate transfer belt 30. The intermediate transfer belt 30 is circulated while being supported by the driving roller 32, a tension roller 33 for applying a suitable tensile force to the intermediate transfer belt 30 through an urging force of a spring (not shown), and a driven roller 34. The driven roller 34 and a secondary transfer roller 36 sandwich the intermediate transfer belt 30 therebetween. The driving roller 32 is constructed by coating a surface of a metallic roller with a rubber material (urethane or chloroprene) having a thickness of several millimeters. Thus, the driving roller 32 is prevented from slipping with respect to the intermediate transfer belt 30. The driving roller 32 is rotationally driven by a stepping motor (not shown).

Primary transfer rollers 35*a*, 35*b*, 35*c*, and 35*d* are respectively arranged at positions facing the photosensitive drums 11*a*, 11*b*, 11*c*, and 11*d* across the intermediate transfer belt 30 (inwardly of the intermediate transfer belt 30). A high voltage for transferring a toner image onto the intermediate transfer belt 30 is applied to the primary transfer rollers 35*a*, 35*b*, 35*c*, and 35*d*.

The secondary transfer roller 36 forms a secondary transfer region with a nip between itself and the intermediate transfer belt 30. The secondary transfer roller 36 is pressed against the intermediate transfer belt 30 at a suitable pressure. A cleaning device 50 for cleaning an image forming surface of the intermediate transfer belt 30 is provided downstream of the secondary transfer region with respect to a rotational direction of the intermediate transfer belt 30 (clockwise in FIG. 1). The cleaning device 50 is composed of a cleaner blade 51 (which is made of a material such as polyurethane rubber or the like) and a waste toner box 52 for storing waste toner.

A patch detecting sensor 76 is disposed downstream of the photosensitive drum 11*a* in the sheet conveying direction. The patch detecting sensor 76 detects a concentration of a reference image (patch image) provided on the intermediate transfer belt 30.

The image forming portion 82 has a fixing unit 40 serving as a fixing device. The fixing unit 40 has a fixing roller 41*a* having therein a heat source such as a halogen heater or the like, a pressure roller 41*b* pressed against the fixing roller 41*a* (the pressure roller 41*b* may also be equipped with a heat source), and an inner delivery roller 44 for conveying and delivering a sheet P delivered from a pair of rollers 41*a* and 41*b*.

One construction of the sheet feed portion 81 will now be described. The sheet feed portion 81 is composed of a portion for storing the sheet (recorded material) P, on which an image is formed, a roller for conveying the sheet P, a sensor for detecting passage of the sheet P, a sensor for detecting the presence or absence of the sheet P, a guide (not shown) for guiding the sheet P along a sheet conveying passage, and the like.

Sheets P are stacked on sheet feed cassettes 21*a*, 21*b*, 21*c*, and 21*d*, a manual tray 27, and a sheet deck 28, which all serve as sheet stacking portions. Pickup rollers 22*a*, 22*b*, 22*c*, and 22*d* send out the sheets P one by one from the sheet feed cassettes 21*a*, 21*b*, 21*c*, and 21*d*, respectively. However, the pickup rollers 22*a*, 22*b*, 22*c*, and 22*d* may send out the sheets P in their stacked-up state. Thus, pairs of separation rollers 23*a*, 23*b*, 23*c*, and 23*d* each separate one of the sheets P sent out in their stacked-up state from one another, convey only one separated from the other sheets, and send back the other sheets P.

The sheet P separated from the others and conveyed by each of the pairs of separation rollers 23*a*, 23*b*, 23*c*, and 23*d* is further conveyed to a pair of registration rollers 25 by a corresponding one of pullout rollers 24*a*, 24*b*, 24*c*, and 24*d* and a pre-registration roller 26. One of the sheets P stacked on the manual tray 27 is separated from the others and conveyed by another pair of separation rollers 29, and then conveyed to the pair of registration rollers 25 by the pre-registration roller 26.

A plurality of sheets P stored in the sheet deck 28 are conveyed to a pair of sheet feed rollers 61 by a pickup roller 60. One of them is separated from the others and conveyed to a pullout roller 62 by the pair of sheet feed rollers 61. The sheet P is then conveyed to the pair of registration rollers 25 by the pre-registration roller 26.

In the following description, the sheet feed cassettes, the pickup rollers, the pairs of separation rollers, and the pairs of pullout rollers will be denoted by reference symbols "21", "22", "23", and "24", respectively, unless a specific one of them is described.

An acceleration sensor 201 is connected to each of the pairs of separation rollers 23*a*, 23*b*, 23*c*, and 23*d*, the pair of separation rollers 29, and the pair of sheet feed rollers 61. The acceleration sensor 201 detects vibrations of the rollers as an acceleration. The acceleration sensor 201 will be described in detail later.

A plurality of sensors for detecting passage of the sheets P are disposed in a conveying passage for the sheets P. The sensors include sheet feed retry sensors 64*a*, 64*b*, 64*c*, and 64*d*, a deck sheet feed sensor 65, a deck pullout sensor 66, a registration sensor 67, an inner sheet delivery sensor 68, a face-down sheet delivery sensor 69, a double-sided pre-registration sensor 70, a double-sided sheet re-feed sensor 71, and the like.

Disposed on the sheet feed cassettes 21*a*, 21*b*, 21*c*, and 21*d*, on which the sheets P are stacked, are cassette sheet presence/absence detecting sensors 63*a*, 63*b*, 63*c*, and 63*d* for detecting the presence or absence of at least one of the sheets P on the sheet feed cassettes 21*a*, 21*b*, 21*c*, and 21*d*, respectively. Disposed on the manual tray 27 is a manual sheet presence/absence detecting sensor 74 for detecting the presence or absence of at least one of the sheets P on the manual tray 27. Disposed on the sheet deck 28 is a deck sheet presence/absence detecting sensor 75 for detecting the presence/absence of at least one of the sheets P in the sheet deck 28.

In the following description, the cassette sheet presence/absence detecting sensors, the sheet feed retry sensors, reverse rollers, and toner bolts will be denoted by reference symbols "63", "64", "72", and "77", respectively, unless a specific one of them is described.

The control unit 85 serving as a control portion, which controls the operation of a mechanism in the color copying machine 1, has a control substrate (not shown) and a motor drive substrate (not shown).

The operational portion 4 is disposed in an upper portion of the color copying machine 1. The operational portion 4 can, for example, select one of the sheet feed cassettes 21*a*, 21*b*, 21*c*, and 21*d*, the manual tray 27, and the sheet deck 28, in which the sheets P are stored, select one of a face-up tray 2 and a face-down tray 3, and designate a tab paper bundle.

Figure 4:
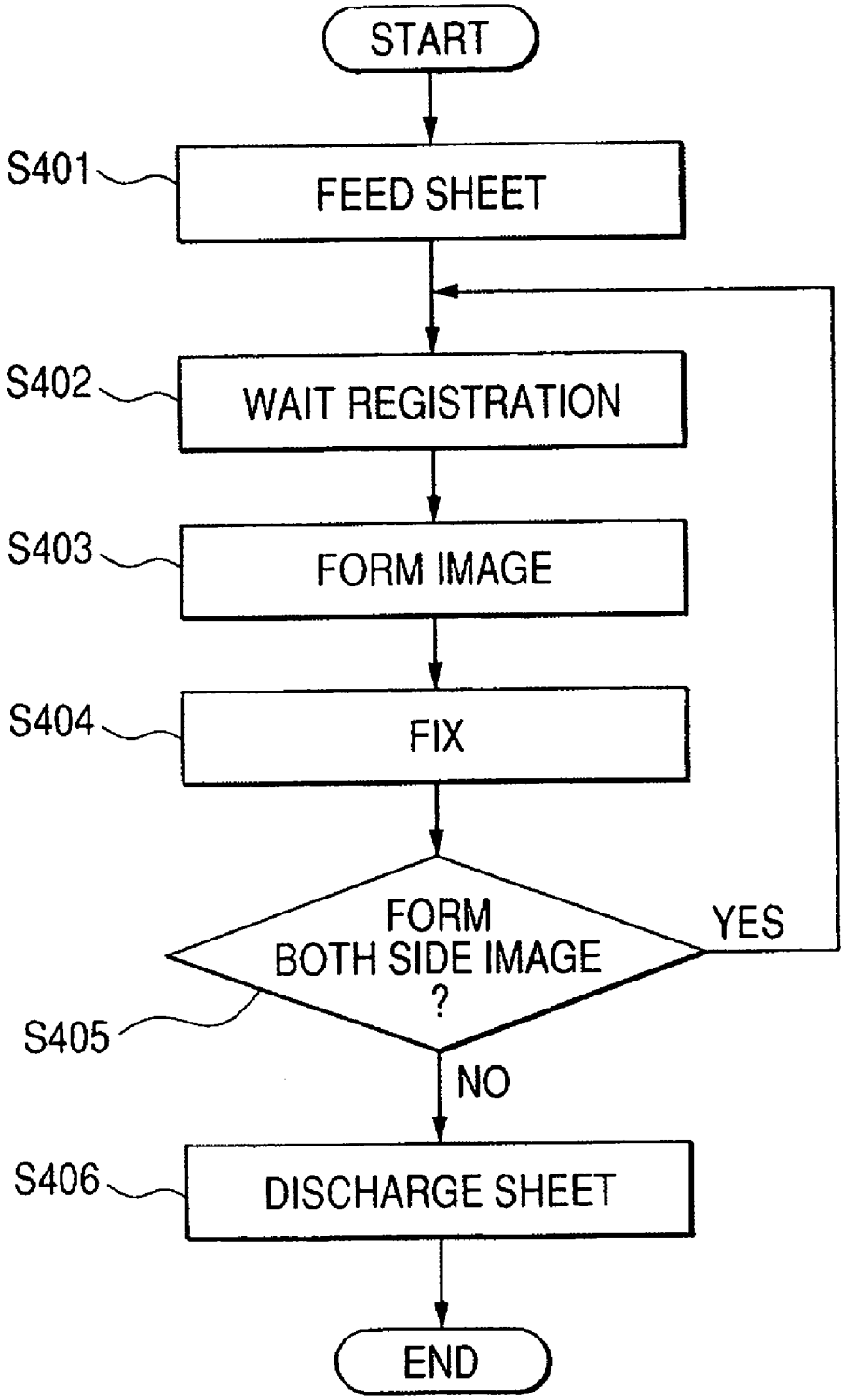
FIG. 4 is a flowchart for schematically explaining an operation of the image forming apparatus.

FIG. 4 is a flowchart for schematically explaining an operation of the color copying machine 1.

A sheet P is fed (step 401 ("step" will be abbreviated hereinafter as "S") and enters a registration awaiting state upon reaching the pair of registration rollers 25 (S402). After that, the pair of registration rollers 25 rotate to establish a state for forming an image on the sheet P (S403). A toner image on the intermediate transfer belt 30 is transferred onto the sheet P in the secondary transfer region. The sheet P, onto which the toner image has been transferred, is conveyed to the fixing unit 40 for fixation (S404). In a single-sided mode for forming an image on one side of the sheet P (NO in S405), the post-fixation sheet P is discharged to the outside of a color copying machine body (S406). On the other hand, in a double-sided mode for forming an image on both sides of the sheet P (YES in S405), the post-fixation sheet P enters a double-sided conveyance state, is conveyed through a double-sided path, and reenters the registration awaiting state (S402). After that, an image is formed on the other side of the sheet P (S403), and fixation of the toner image is carried out (S404). Then, the sheet P is discharged to the outside of the color copying machine 1 (S406).

An operation of the color copying machine 1 will now be described. An operation of forming a toner image on one side of the sheet P will be described.

When a user inputs, by the operational portion 4, image forming information such as a sheet size required for formation of an image, a number of copies, and the like to the color copying machine 1 and presses an image starting button, the color copying machine 1 sends out a sheet P from the sheet feed cassette 21*a* by the pickup roller 22*a* after the lapse of a predetermined time. The pair of separation rollers 23 convey the sheet P thus sent out to the pair of pullout rollers 24. When sheets P are sent out in their stacked-up state, the pair of separation rollers 24 separate each one of the sheets P from the others and convey the separated sheet P to the pair of pullout rollers 24. The pair of pullout rollers 24 and the pre-registration roller 26 convey the sheet P to the pair of registration rollers 25. The pair of registration rollers 25 are stopped and receive a front end of the sheet P with a nip.

After that, the pair of registration rollers 25 start rotating. The pair of registration rollers 25 start rotating when the sheet P is sent thereinto as soon as a toner image primarily transferred onto the circulating intermediate transfer belt 30 reaches the secondary transfer roller 36.

In the image forming portion 82, the roller charging devices 12 electrify surfaces of the respective photosensitive drums 11 with a uniform amount of charges. The scanners 13 then irradiate the respective photosensitive drums 11 with rays, for example, laser beams or the like, which have been modulated in accordance with a recorded image signal, and thus expose the respective photosensitive drums 11. Electrostatic latent images are formed on exposed portions of the respective photosensitive drums 11.

The electrostatic latent images of the photosensitive drums 11*a*, 11*b*, 11*c*, and 11*d* are developed into toner images by the developing devices 14*a*, 14*b*, 14*c*, and 14*d*, respectively, in which developers (toners) of four colors, that is, yellow (Y), cyan (C), magenta (M), and black (Bk) are stored. The toner images of the respective colors are sequentially transferred onto the intermediate transfer belt 30 in an overlapping manner. The developing devices 14*a*, 14*b*, 14*c*, and 14*d* are replenished with the toners through toner bottles 77*a*, 77*b*, 77*c*, and 77*d*, respectively. Disposed in the developing devices 14*a*, 14*b*, 14*c*, and 14*d* are inductance sensors (not shown) for monitoring concentrations of the toners in the developing devices 14*a*, 14*b*, 14*c*, and 14*d*, respectively.

When an image forming operation starting signal is issued, the toner image formed through the foregoing process on the photosensitive drum 11*d*, which is located on the most upstream side in the rotational direction of the intermediate transfer belt 30, is primarily transferred onto the intermediate transfer belt 30 in a primary transfer region by the primary transfer roller 35*d*, to which a high voltage has been applied. After that, the photosensitive drums 11*c*, 11*b*, and 11*a* and the primary transfer rollers 35*c*, 35*b*, and 35*a*, which are located on the downstream side, sequentially primarily transfer toner images onto the intermediate transfer belt 30. Finally, a toner image of the four colors is primarily transferred onto the intermediate transfer belt 30.

After that, the upstream rollers including the pair of registration rollers 25 start rotating again in accordance with positions of the toner images on the intermediate transfer belt 30, and send out the sheet P to the secondary transfer region. In the secondary transfer region, the toner image on the intermediate transfer belt 30 is transferred onto the sheet P by the secondary transfer roller 36. The intermediate transfer belt 30 and the secondary transfer roller 36, which sandwich the sheet P therebetween, secondarily transfer the toner image onto the sheet P while conveying the sheet P to the fixing unit 40.

The fixing unit 40 then heats and pressurizes the sheet P by the fixing roller 41*a* and the pressure roller 41*b*, thereby fixing the toner image onto the sheet P. A switching flapper 73 makes a switch in sheet conveying destination of the sheet P that has passed through the inner delivery roller 44.

When the sheet P is discharged in a face-up state in which the toner image faces upward, the switching flapper 73 guides the sheet P to an outer delivery roller 45 with a front end of the sheet P (the upstream side in the sheet conveying direction) facing upward. The outer delivery roller 45 discharges the sheet P into the face-up tray 2 in the face-up state. When the sheet P is discharged in a face-down state in which the toner image faces downward, the switching flapper 73 guides the sheet P to a pair of reverse rollers 72*a* with the front end of the sheet P (the upstream side in the sheet conveying direction) facing downward. The pairs of reverse rollers 72*a*, 72*b*, and 72*c* convey the sheet P and discharge it into the face-down tray 3 in the face-down state.

Next, an operation of forming an image on both sides of the sheet P will be described.

The switching flapper 73 guides the sheet P, onto on side of which the toner image is fixed by the fixing unit 40, to the reverse rollers 72. The reverse rollers 72 convey the sheet P toward the face-down tray 3. When a rear end of the sheet P has passed the switching flapper 73 and reached a position denoted by reference symbol R of FIG. 1, the reverse rollers 72 are inverted and send the sheet P into return passage rollers 78*a*, 78*b*, 78*c*, and 78*d* in the stated order. The sheet P is thereby conveyed in a switchback manner and inverted. The return passage rollers 78*a*, 78*b*, 78*c*, and 78*d* send the sheet P into the pre-registration roller 26. After that, the toner image is formed on the other side of the sheet P as well.

Figure 2:
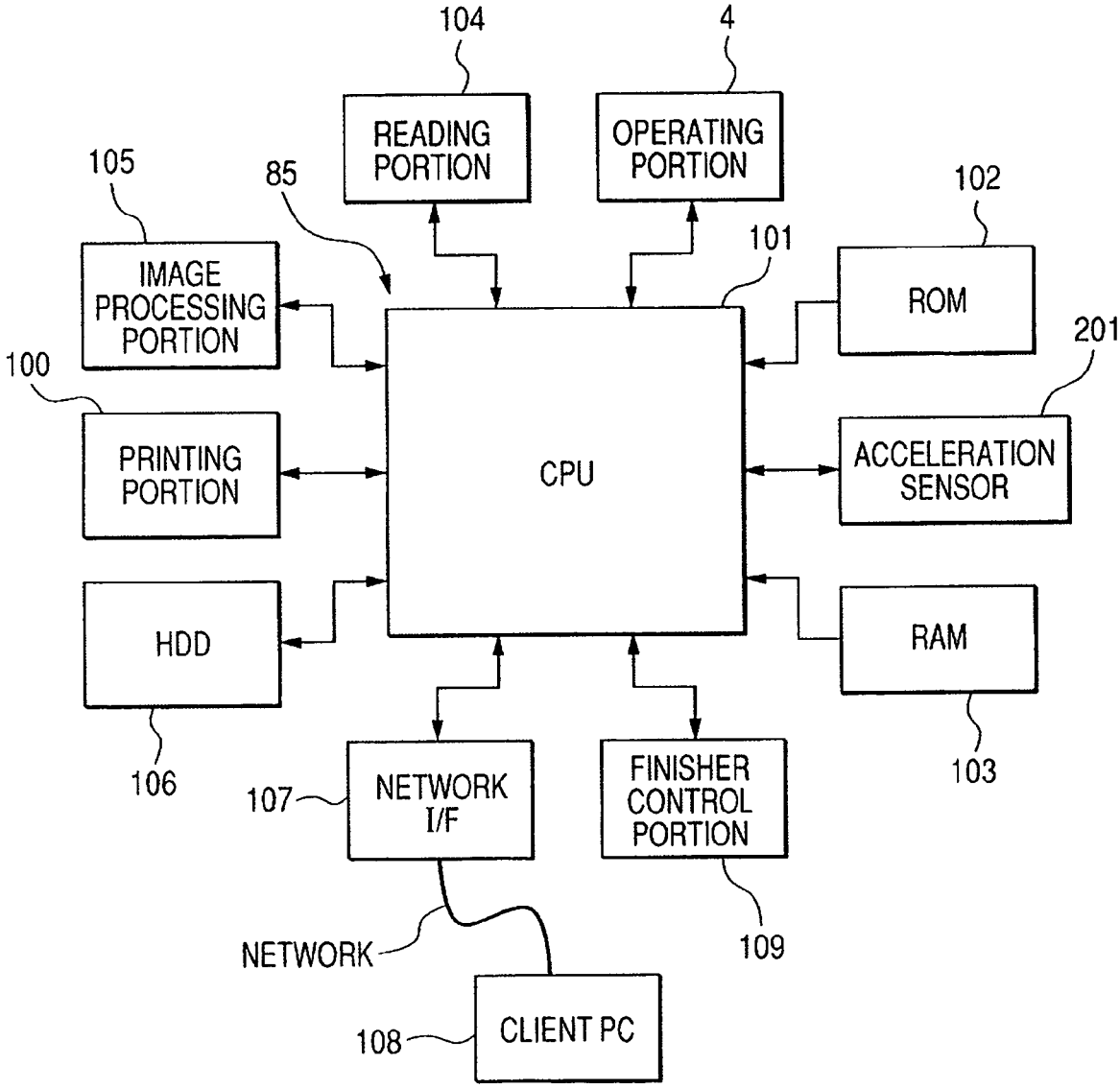
FIG. 2 is a control block diagram of a control unit of a color copying machine according to an embodiment of the present invention.

FIG. 2 is a control block diagram of the control unit 85, which serves as a sheet type discriminating portion and a control portion of the color copying machine 1 according to this embodiment.

A CPU 101 mainly performs basic control of the color copying machine 1. A ROM 102 into which a control program has been written and a work RAM 103 for performing various processings are connected to the CPU 101 via an address bus or a data bus. Various loads for performing the image forming operation, such as a motor (not shown), a clutch (not shown), a sensor (not shown), and the like are connected to the CPU 101. The CPU 101 performs the image forming operation in accordance with the control program in the ROM 102.

The operational portion 4 is connected to the CPU 101. In addition, a reader portion 104 for converting an original image into digital data, an image processing portion 105 for subjecting digital data to an image processing, and an HDD 106 for storing image data processed by the image processing portion 105 are connected to the CPU 101.

A network I/F 107 is an interface for inputting/outputting data into/from an external client PC 108 connected thereto via a network. For instance, the network I/F 107 can store into the HDD 106 PDL information which has been sent from the client PC 108 via the network and output the PDL information to a printer portion 100 as image data, or store into the HDD 106 image data read by the reader portion 104 and output the image data to the client PC 108 via the network.

Furthermore, a finisher control portion 109, which issues a command to subject the sheet P discharged from the printer portion 100 to a finishing processing, is connected to the CPU 101.

Acceleration sensors 201 as vibration detecting sensors are connected to the CPU 101. The acceleration sensors 201, which are connected to the pairs of separation rollers 23*a*, 23*b*, 23*c*, and 23*d* as pairs of conveying rotary members, the pair of separation rollers 29 of the manual tray 27, and the pair of sheet feed rollers 61 of the sheet deck 28, respectively, detect vibrations of the respective pairs of the rollers as accelerations. Based on pieces of information on vibrations of the respective rollers detected by the acceleration sensors 201, the CPU 101 makes a discrimination in a type of the sheet P and sets an image forming condition most suited for the sheet P. The setting of the image forming condition will be described later.

The acceleration sensors 201 detect vibrations from the acceleration of the respective pairs of the separation rollers 29, and issue signals corresponding to the detected vibrations.

Figure 8:
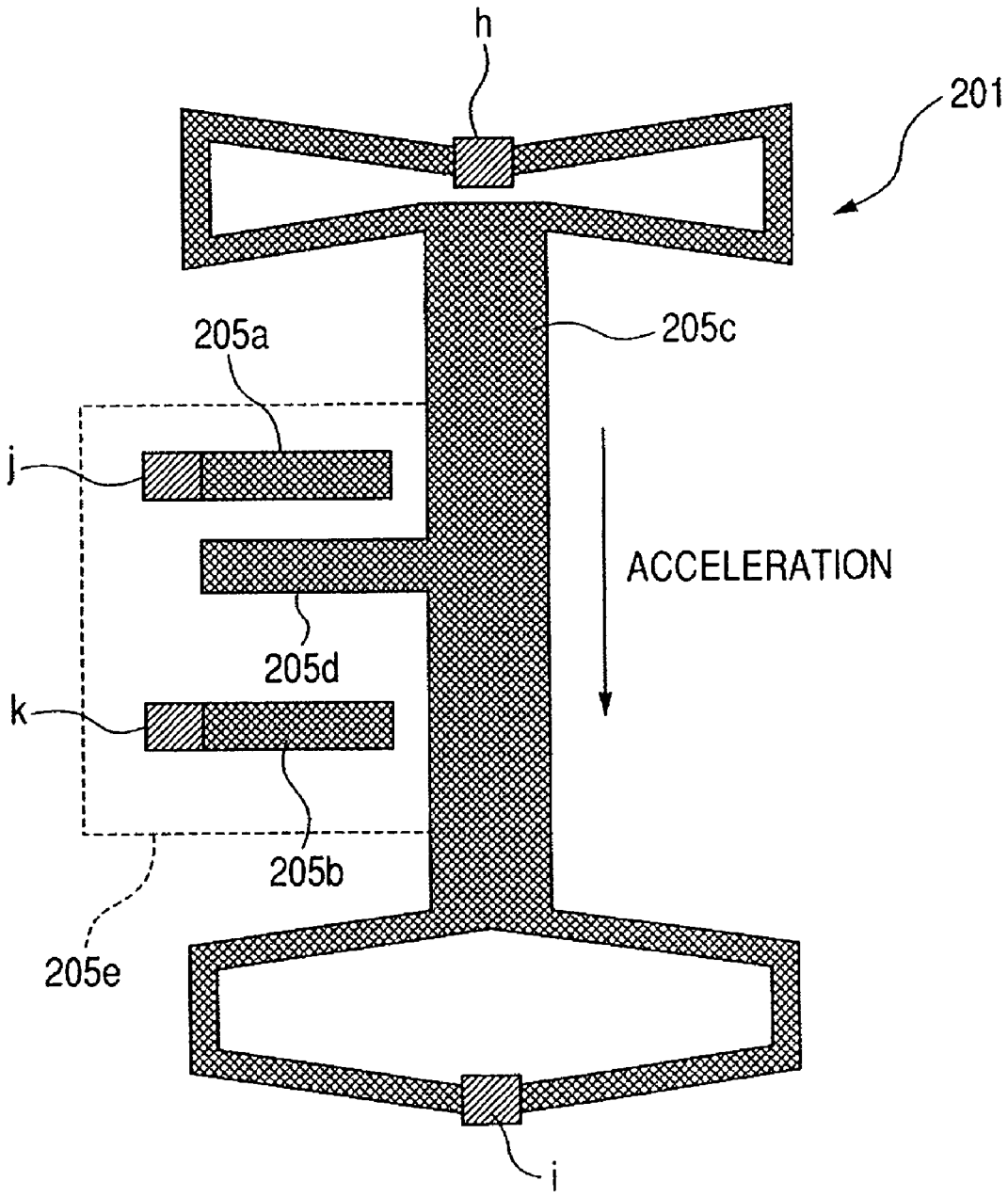
FIG. 8 is a view showing a structure of the acceleration sensor.

FIG. 8 is a view showing a basic structure of each of the acceleration sensors 201. The acceleration sensor 201 is a converter for converting vibrations into an electric quantity. There are various types of acceleration sensors. Some representative ones of them include a capacitance type acceleration sensor, a piezoelectric type acceleration sensor, and the like. This embodiment deals with a case in which an acceleration sensor manufactured by Analog Devices, Inc. is used as a capacitance type acceleration sensor.

The acceleration sensor 201 is a capacitance type acceleration sensor. The acceleration sensor 201, whose surface has a polysilicon structure subjected to micro machining, is formed on a silicon wafer. This structure is supported on a surface of the wafer by a spring made of polysilicon, and resists a force generated by an acceleration. Anchors (fixed portions) are denoted by reference symbols h, i, j, and k, respectively. In this structure, a differential capacitor 205*e* is composed of fixed plates 205*a* and 205*b*, which are independent of each other, and a central plate 205*d* mounted on a movable mass portion (beam) 205*c*. Square wave signals that are different in phase from each other by 180° are applied to the fixed plates 205*a* and 205*b*, and vibrations of the structure are detected from changes in a signal generated by the differential capacitor 205*e*. That is, when no vibration of the beam 205*c* results from an acceleration, electric signals between the fixed plates 205*a* and 205*b* counterbalance each other, so an output signal from the differential capacitor 205*e* assumes a value substantially equal to 0. On the other hand, when the beam 205*c* vibrates due to an acceleration, imbalance occurs in the differential capacitor 205, so an output signal of square waves having an amplitude proportional to the acceleration is generated by the differential capacitor 205*e*.

Figure 3:
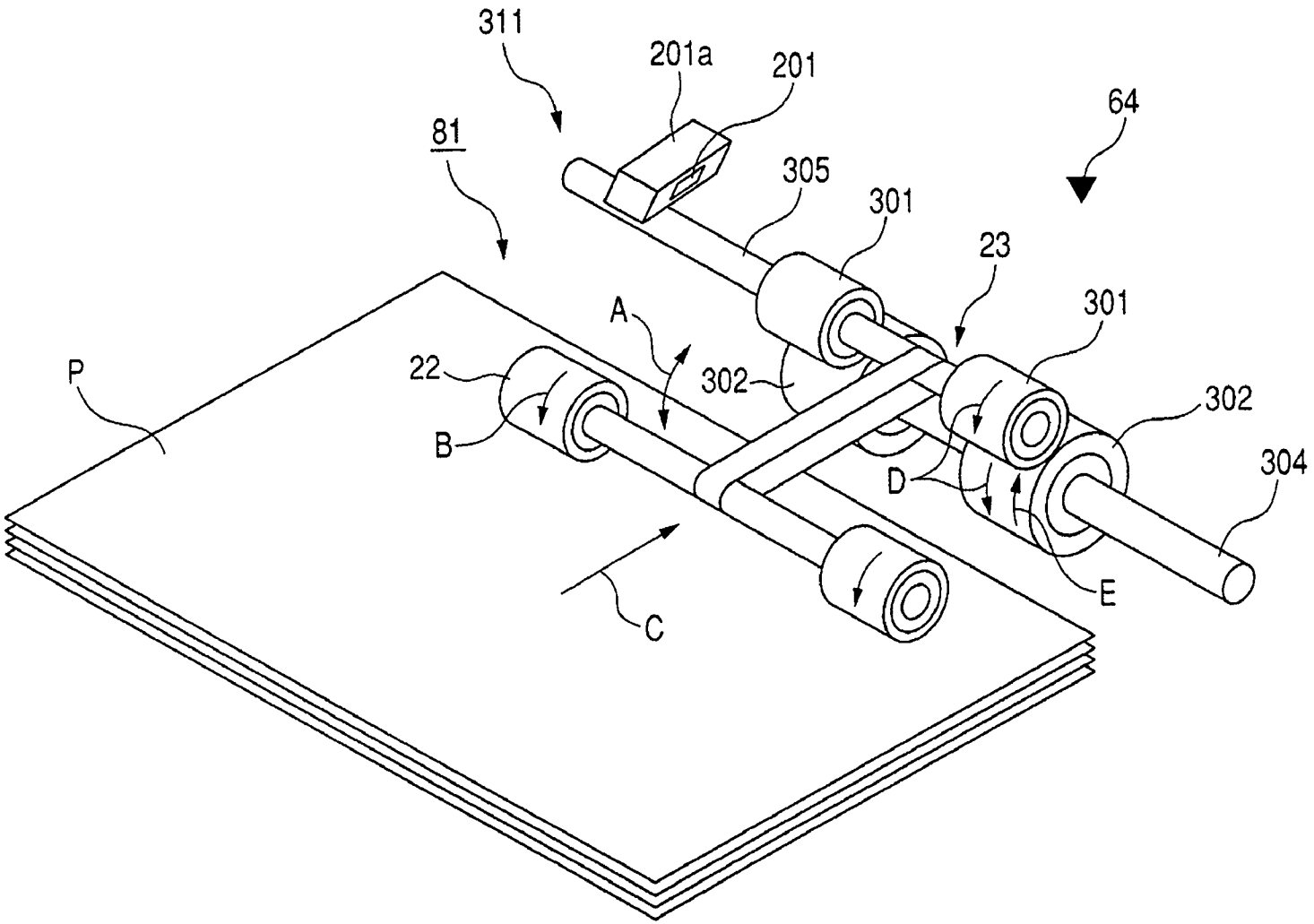
FIG. 3 is an external perspective view of a sheet feed portion.

FIG. 3 is a view showing part of the sheet feed portion 81.

The pickup roller 22 is vertically moved in directions indicated by an arrow A by turning a solenoid (not shown) ON/OFF. When the sheet P is fed, the pickup roller 22 moves downward to come into contact with the sheet P, rotates in a direction indicated by an arrow B, and sends out the sheet P in a direction of the sheet conveying passage (in a direction indicated by an arrow C).

The pair of separation rollers 23 then send out the single sheet P in the direction of the sheet conveying passage (in the direction indicated by the arrow C). The pair of separation rollers 23 are composed of a sheet feed roller 301 as a conveying rotary member and a separation roller 302. The separation roller 302 rotates while following via the single sheet P the sheet feed roller 301 in a direction indicated by an arrow E.

However, when the plurality of sheets P are sent out in their stacked-up state by the pickup roller 22, the separation roller 302 of the pair of separation rollers 23 rotates in a direction indicated by an arrow D. The sheet feed roller 301 thereby sends out an uppermost one of the sheets P in the direction indicated by the arrow C, while the separation roller 302 returns the lower sheets P to the sheet feed cassettes 21 (the manual tray 27/the sheet deck 28). As a result, the pair of separation rollers 23 can separate the sheets P from one another and convey them one by one.

A rotational force acting in the direction indicated by the arrow D is usually applied to the separation roller 302. Thus, the separation roller 302 can separate the sheets P from one another in the direction indicated by the arrow D and convey them one by one. However, when only one of the sheets P is sent to the separation roller 302, the separation roller 302 must rotate while following the sheet feed roller 301 in the direction indicated by the arrow E as described above. Thus, a torque limiter (not shown) for allowing the separation roller 302 to rotate while following the sheet feed roller 301 is provided between the separation roller 302 itself and a drive shaft 304 of the separation roller 302.

The torque limiter transmits a rotational force of the drive shaft 304 of the separation roller 302, which rotates in the direction indicated by the arrow D. When the separation roller 302 receives a torque equal to or larger than a predetermined value in the direction indicated by the arrow E, the torque limiter allows the separation roller 302 to rotate in the direction indicated by the arrow E, although the drive shaft 304 rotates in the direction indicated by the arrow D.

A sensor holding plate 201*a*, on which the acceleration sensor 201 is mounted, is in contact with the drive shaft 304 of the sheet feed roller 301. The acceleration sensor 201 detects vibrations of the drive shaft 304 of the sheet feed roller 301 as an acceleration and transmits it to the CPU 101. The acceleration sensor 201 may be mounted on a bearing of the sheet feed roller 301.

The sheet feed retry sensors 64 each transmit to the CPU 101 information on the presence or absence of at least one of the sheets P on the sheet conveying passage.

In the construction described above, the pair of separation rollers 23 for conveying the sheets P, the acceleration sensors 201 for detecting vibrations of the pair of separation rollers 23, and the control unit 85 for making discriminations in the types of the sheets P based on information on vibrations detected by the acceleration sensors 201 constitute the sheet discriminating apparatus 311. The pair of separation rollers 29, the acceleration sensors 201, and the control unit 85 also constitute a sheet discriminating apparatus 312. Furthermore, the sheet feed rollers 61, the acceleration sensors 201, and the control unit 85 also constitute a sheet discriminating apparatus 313.

Figure 5:
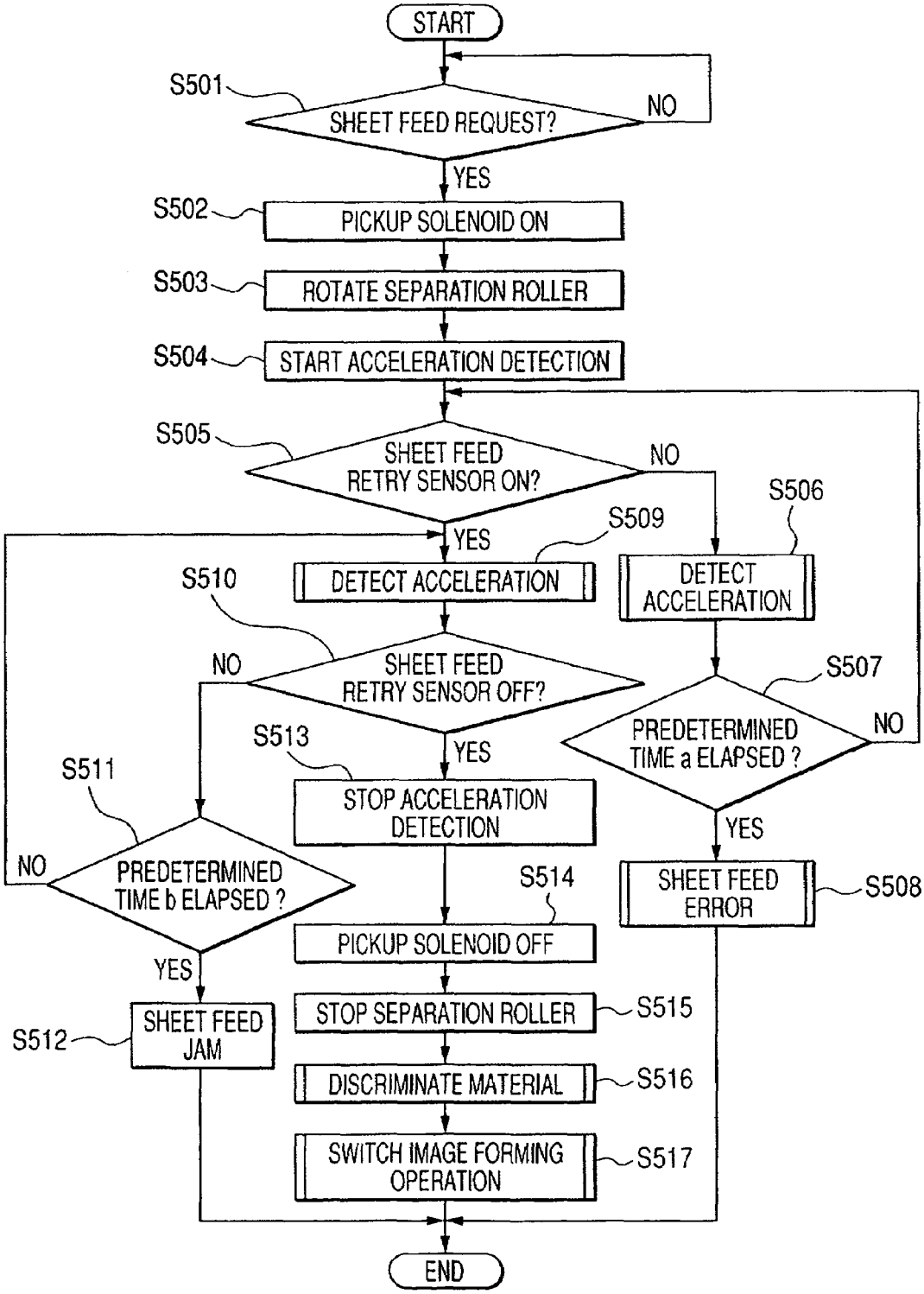
FIG. 5 is a flowchart for explaining an operation performed in feeding a sheet.

FIG. 5 is a flowchart for explaining an operation performed in feeding one sheet.

First, the CPU 101 (see FIG. 2) waits for a sheet feed request (S501). Upon receiving the sheet feed request, the CPU 101 causes the pickup roller 22 to rotate and move downward, thereby sending out the sheet P in the direction of the sheet conveying passage (in the direction indicated by the arrow C) (S502). Almost simultaneously, the CPU 101 causes the pair of separation rollers 23 to rotate (S503).

At this moment, the sheet P has not reached the pair of separation rollers 23. Thus, the separation roller 302 rotates in the direction of the sheet conveying passage (in the direction indicated by the arrow E) while following the sheet feed roller 301. When the sheet feed roller 301 starts rotating, the acceleration sensor 201 starts detecting vibrations of the pair of separation rollers 23.

Then, the CPU 101 waits for the sheet feed retry sensor 64 to turn ON (S505). When the sheet feed retry sensor 64 is OFF, the acceleration sensor 201 continues to detect vibrations until the sheet feed retry sensor 64 turns ON (S506, S507, S505). When the sheet feed retry sensor 64 does not turn ON even after the lapse of a predetermined time a, the CPU 101 determines that an attempt to feed the sheet P has failed, and terminates detection of vibrations (S508).

When the sheet feed retry sensor 64 turns ON within the predetermined time a (S507, S505), the acceleration sensor 201 continues to detect vibrations (S509). In this case, when the sheet feed retry sensor 64 does not turn OFF within a predetermined time b after having turned ON (YES in S511), the CPU 101 determines that the pair of separation rollers 23 have been jammed with the sheet P, and terminates detection of vibrations (YES in S511, S512).

When the sheet feed retry sensor 64 turns OFF within the predetermined time b (NO in S511, YES in S510), the CPU 101 terminates detection of vibrations of the sheet feed roller 301 by the acceleration sensor 201 (S513). After that, the CPU 101 separates the pickup roller 22 from the sheet P (S514), stops rotation of the pair of separation rollers 23, and terminates the operation of feeding the sheet P (S515).

After that, the CPU 101 makes a determination on the type of the sheet P (whether or not the surface of the sheet P is coarse, whether the sheet P is thick paper or thin paper, and the like) from a result of detection of the acceleration (S516), and makes a switch in image forming operation in a sequent stage based on a result of the determination (S517).

The operation of separating the pickup roller 22 from the sheet P should not necessarily be performed at a timing shown in this flowchart. For instance, the pickup roller 22 may be brought into contact with the sheet P and then separated therefrom after the lapse of a predetermined time. Alternatively, the pickup roller 22 may be separated from the sheet P as soon as it is determined that the sheet P has reached the pair of separation rollers 23 after the acceleration sensor 201 has detected vibrations.

Figure 6:
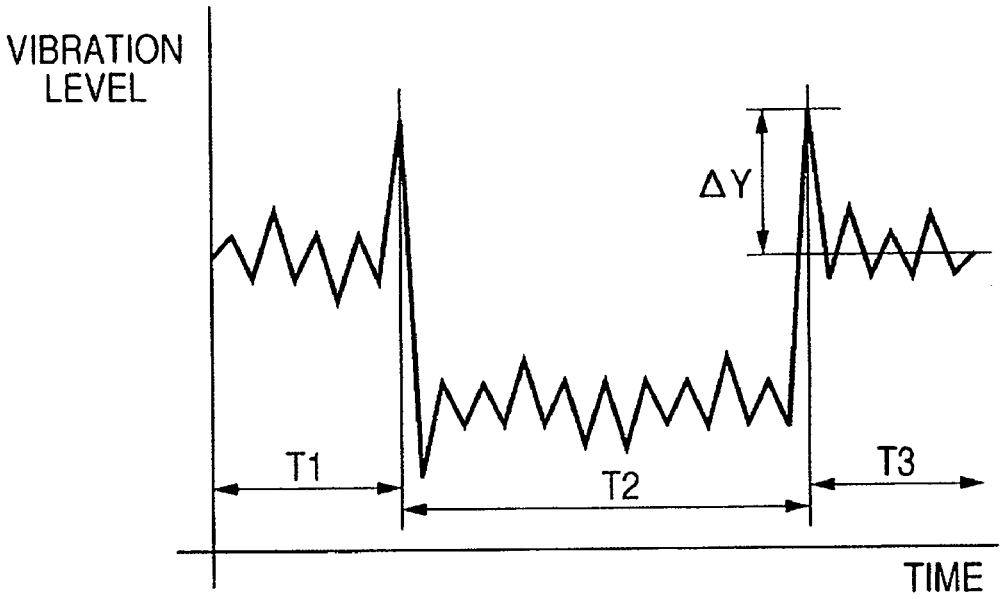
FIG. 6 is a vibration graph obtained by plotting in a time-series manner vibrational conditions of a sheet feed roller, which have been detected by an acceleration sensor, when a sheet is fed normally.

FIG. 6 is a vibration graph obtained by plotting in a time-series manner vibrational conditions of the sheet feed roller 301 detected by the acceleration sensor 201, when the sheet P is fed normally. In this graph, an axis of ordinate represents a detected vibrational level, and an axis of abscissa represents a time. The vibrational level corresponds to an amplitude. The CPU 101 functions also as a vibration detecting portion for detecting an amplitude of vibrations of the sheet feed roller 301 based on vibrational information transmitted from the acceleration sensor 201.

From a time-series point of view, a vibrational level can be broadly classified into three phases, namely, time zones T1, T2, and T3. The time zone T1 indicates a vibrational condition of the sheet feed roller 301 prior to the arrival of the sheet P at the pair of separation rollers 23. The time zone T2 indicates a vibrational condition of the sheet feed roller 301 at a time when the pair of separation rollers 23 convey the sheet P. The time zone T3 indicates a vibrational condition of the sheet feed roller 301 after passage of the sheet P through the pair of separation rollers 23.

In the time zone T1, the separation roller 302 rotates while being driven by the sheet feed roller 301 (rotates in the direction indicated by the arrow E of FIG. 3), that is, rotates reversely in a direction different from its original rotational direction. It is therefore apparent that vibrations of the separation roller 302 are transmitted to the sheet feed roller 301, and vibrates widely. On a border between the time zone T1 and the time zone T2, it is apparent that the sheet feed roller 301 has vibrated widely as a result of a plunge of the sheet P into the pair of separation rollers 23.

In the time zone T2, the sheet feed roller 301 and the separation roller 302 rotate reversely with respect to each other. However, the sheet P is interposed between the sheet feed roller 301 and the separation roller 302, so the sheet feed roller 301 vibrates less widely in comparison with the time zone T1 in which the sheet feed roller 301 and the separation roller 302 are in direct contact with each other. On a border between the time zone T2 and the time zone T3, it is apparent that the sheet feed roller 301 has vibrated widely due to passage of the rear end of the sheet P through the pair of separation rollers 23. The vibrational condition of the sheet feed roller 301 in the time zone T3 is similar to that of the sheet feed roller 301 in the time zone T1.

Based on a vibration level ΔY of vibrations generated upon a shift from the time zone T2 to the time zone T3, that is, upon passage of the rear end of the sheet P through the pair of separation rollers 23, the CPU 101 makes a discrimination in the type of the sheet P, for example, determines whether or not the sheet P is thick paper. The reference symbol ΔY represents the difference of the peak of the vibrational level at a moment when the rear end of the sheet P passes through the pair of separation rollers 23 and the mean value of the vibrational level when a sheet is not conveying by the pair of separation rollers 23. In this embodiment, when ΔY is larger than a predetermined threshold, the CPU 101 determines that the sheet P is thick paper. When ΔY is equal to or smaller than the predetermined threshold, the CPU 101 determines that the sheet P is thinner than thick paper.

It can be found that CPU 101 determines that the sheet is a thick sheet when the amplitude at a moment when the rear end of the sheet P passes through the pair of separation rollers 23 detected by the acceleration sensor 201 is larger than a predetermined value, and CPU 101 determines that the sheet is a sheet thinner than the thick sheet when the amplitude at a moment when the rear end of the sheet P passes through the pair of separation rollers 23 detected by the acceleration sensor 201 is equal to or smaller than the predetermined value.

The CPU 101 makes a discrimination in surface smoothness of the sheet P based on an amplitude of vibrations during conveyance of the sheet P by the pair of separation rollers 23 in the time zone T2.

As described above, the sheet discriminating apparatus 311 according to this embodiment makes a discrimination in the type of the sheet P (whether or not the sheet P has a coarse surface, whether or not the sheet P is thick paper, and the like).

In the foregoing description, the sheet discriminating apparatus 311 determines whether the sheet P is thick paper or thin paper based on a change in the vibrational level caused upon passage of the sheet P through the pair of separation rollers 23, because an accurate discrimination in sheet type can be made due to the insusceptibility to the influence of the bending of the sheet P unlike the case of vibrations caused upon a plunge of the sheet P into the pair of separation rollers 23.

The sheet discriminating apparatus 311 detects a surface smoothness of the sheet P when the pair of separation rollers 23 convey the sheet P while sandwiching it therebetween, so as not to fail to obtain vibrational information making use of the fact that the pair of separation rollers 23 definitely vibrate in accordance with the surface smoothness of the sheet P unlike a conventional case in which a discrimination in sheet type is made based on vibrations obtained in accordance with a contact state of a sheet.

For those reasons, the sheet discriminating apparatus 311 exhibits an enhanced sheet discriminating accuracy. Other sheet discriminating apparatuses 312 and 313 also perform a similar sheet discriminating operation and thus exhibit an enhanced sheet discriminating accuracy.

The color copying machine 1 is designed such that the CPU 101 adjusts a speed at which the sheet P is conveyed by the intermediate transfer belt 30 and the secondary transfer roller 36 based on information on the type of the sheet P which is transmitted from the sheet discriminating apparatuses 311, 312, and 313, especially based on information on the surface smoothness and thickness of the sheet P, thereby making it possible to reliably transfer a toner image from the intermediate transfer belt 30 onto the sheet P in accordance with the type of the sheet P.

In other words, the image forming apparatus according to the aforementioned embodiment is designed such that the control portion controls a sheet conveying speed of the image forming portion 82 in accordance with the type of the sheet P in which a discrimination has been made by the sheet discriminating apparatus, which exhibits a high sheet discriminating accuracy. As a result, an image can be formed on the sheet P while the sheet P is conveyed at a sheet conveying speed most suited for the type of the sheet P, so an improvement in image quality can be achieved.

The color copying machine 1 is designed such that the CPU 101 adjusts a fixing temperature of the fixing unit 40 in accordance with the surface smoothness and thickness of the sheet P which have been detected by the sheet discriminating apparatuses 311, 312, and 313. As a result, a toner image can be reliably fixed onto the sheet P. Even if the temperature of the fixing unit 40 needs to be raised above a maximum permissible temperature, the CPU 101 changes the sheet conveying speed in the fixing unit 40 while holding the temperature of the fixing unit 40 equal to or lower than the maximum permissible temperature, or changes the sheet conveying speed while always holding the temperature of the fixing unit 40 constant, thereby making it possible to reliably fix the toner image onto the sheet P without damaging the fixing unit 40.

In other words, the image forming apparatus according to the aforementioned embodiment is designed such that the control portion controls at least one of the sheet conveying speed and heating temperature of the fixing unit 40 in accordance with the type of the sheet P in which a discrimination has been made by the sheet discriminating apparatus, which exhibits a high sheet discriminating accuracy. As a result, the toner image can be reliably fixed onto the toner image, so an improvement in image quality can be achieved.

In general, the color copying machine 1 makes it more difficult to transfer a toner image as the surface of the sheet P becomes coarser or as the sheet P becomes thicker. Accordingly, the sheet conveying speed is reduced as the sheet P becomes thicker. Also, the sheet conveying speed is reduced as the surface of the sheet P becomes coarser. Since fixation of the toner image also becomes difficult to perform, the temperature of the fixing unit 40 is raised, or the sheet conveying speed is reduced. That is, for example, when it is determined that the sheet P is thick paper, the fixing temperature of the fixing unit 40 is made higher than a fixing temperature at a time when it is determined that the sheet P is thin paper. When it is determined that the sheet P is thick paper, the sheet conveying speed of the fixing unit 40 is made lower than a sheet conveying speed at the time when it is determined that the sheet P is thin paper. The control unit 85 controls the image forming portion 82 in this manner.

The sheet discriminating apparatus 311 can make a discrimination in sheet type making use of vibrations of the pair of separation rollers 23 at an early point of time when the sheet P is sent out from the sheet feed cassette 21, that is, at a point of time when the sheet P is passing through the pair of separation rollers 23 for first conveying the sheet P that has been sent out from the sheet feed cassette 21. By the same token, the other sheet discriminating apparatuses 312 and 313 can also obtain information on the material of the sheet P at an early point of time when the sheet P is conveyed. Therefore, the color copying machine 1 equipped with those sheet discriminating apparatuses 311, 312, and 313 has an ample time for setting a transfer condition and a fixing condition, thereby making it possible to form a high-quality image on the sheet P. Also, the toner image can be reliably fixed onto the sheet P.

That is, in the image forming apparatus equipped with the sheet discriminating apparatus disclosed in, for example, JP 2001-233500 A, the acceleration sensor is provided close to the transfer roller. Therefore, the time required until the image forming conditions such as the sheet conveying speed in the nip or the fixing device, the fixing temperature of the fixing device, and the like are controlled after the sheet discriminating information has been obtained from the sheet discriminating apparatus is short, so there is also a fear in that the toner image cannot be transferred or fixed under optimum conditions corresponding to the type of the sheet. In this embodiment, however, the sheet discriminating apparatus detects vibrations of the pair of separation rollers, namely, the pair of rollers located on the most upstream side. Therefore, it takes a long time to form an image after a discrimination in sheet type has been made. In this embodiment, the image can be formed after a shift to the image forming condition corresponding to the type of the sheet P has been made.

Next, a mode of detecting the sending of the sheets P in their stacked-up state based on an output from the acceleration sensor 201 will be described. In this mode, the acceleration sensor 201 is provided on one of the pair of pullout rollers 24. The acceleration sensor 201 is mounted thereon in the same manner as it is mounted on the above-mentioned pair of the separation rollers 23.

Figure 7:
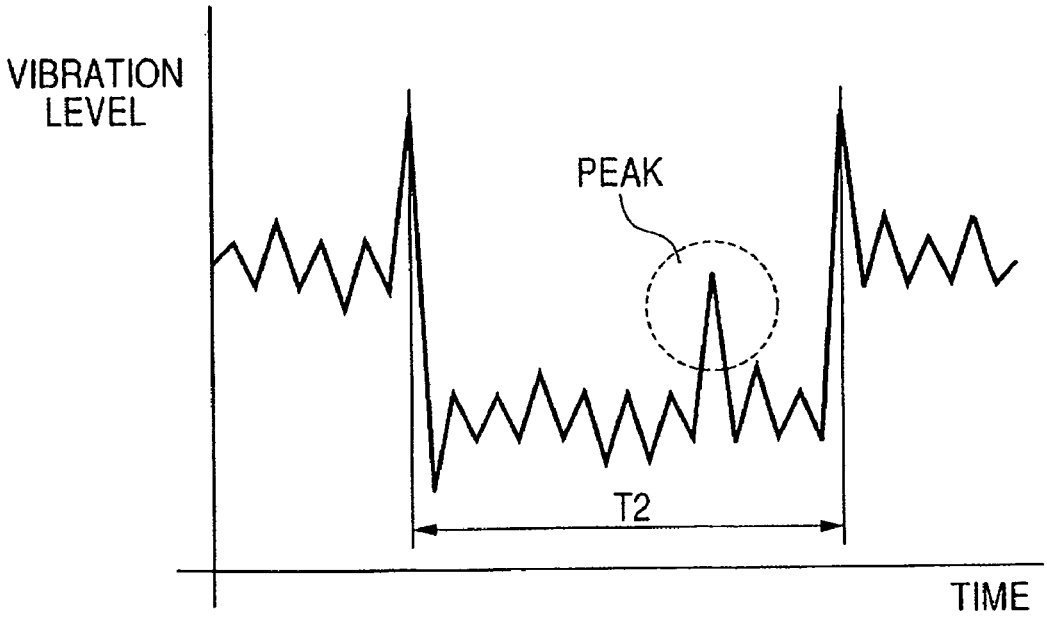
FIG. 7 is a graph obtained by plotting changes in vibrational conditions of the sheet feed roller, which are detected by the acceleration sensor, as is the case with FIG. 6.

FIG. 7 is a graph obtained by plotting changes in vibrational conditions of the roller 24*a*, namely, one of the pair of pullout rollers 24, which are detected by the acceleration sensor 201, in a case where the pair of pullout rollers 24 convey the sheets P in their stacked-up state. In a phase of the time zone T2 shown in FIG. 7, a vibrational peak is detected. This vibration is generated because the sheets P have been conveyed in their stacked-up state by the pair of pullout rollers 24 and some of the sheets P have passed therethrough. Referring to FIG. 7, an axis of ordinate represents a level of detected vibrations, while an axis of abscissa represents a time. In this mode as well, as is the case with the aforementioned embodiment of the present invention, a discrimination in sheet type is made when the rear ends of the sheets P pass through the pair of pullout rollers 24.

It is also possible to detect that the sheets P have been conveyed in their stacked-up state without being duly separated from one another by the pair of separation rollers 23, based on an output from the acceleration sensor 201 provided on the pair of separation rollers 23. In this case, it is appropriate to determine that the sheets P have been conveyed in their stacked-up state, unless the rear end of a certain one of the sheets P is detected after the lapse of a predetermined time corresponding to the length in the sheet conveying direction from a moment when the front end of that sheet P is detected based on an output from the acceleration sensor 201. A determination on detection of conveyance of the sheets P in their stacked-up state can be made earlier based on an output from the acceleration sensor 201 provided on the pair of separation sensors 23 than the conventional determination on detection of conveyance of the sheets P in their stacked-up state. In other words, a determination on detection of conveyance of the sheets P in their stacked-up state, which can be made according to the conventional art only by monitoring a state of the sheet feed retry sensor 64 and detecting that the sheet feed retry sensor 64 remains ON longer than the predetermined time b, can be made earlier by detecting a vibrational level of the pair of separation rollers 23 by the acceleration sensor 201 while the pair of separation rollers 23 are feeding the sheets P.

Pairs of belts may be employed instead of the pairs of separation rollers 23*a*, 23*b*, 23*c*, and 23*d*, the pair of separation rollers 29 of the manual tray 27, and the pairs of sheet feed rollers 61 of the sheet deck 28. Accordingly, the pairs of conveying rotary members should not be limited to the pairs of rollers.

Although the foregoing description handles the color copying machine 1 as an example of the image forming apparatus, a black-and-white copying machine may be employed instead. In the case of the black-and-white copying machine, a toner image is directly transferred onto a sheet from a photosensitive drum, so a speed at which the sheet is conveyed by the photosensitive drum and a transfer roller is controlled based on sheet discriminating information obtained by a sheet discriminating apparatus.

Furthermore, although the sheet discriminating apparatuses 311, 312, and 313 are incorporated in the color copying machine 1, they may also be in a printer for forming an image on a sheet through discharge of ink from an injection head. In this case, the printer forms an image on a sheet while controlling a sheet conveying speed based on sheet discriminating information obtained from the sheet discriminating apparatuses 311, 312, and 313, thereby making it possible to form a high-quality image on the sheet.

This application claims priority from Japanese Patent Application No. 2005-106928 filed on Apr. 1, 2005, which is hereby incorporated by reference herein.

What is claimed is:

1. A sheet discriminating apparatus comprising:

a pair of conveying rotary members for conveying a sheet while rotating with the sheet sandwiched between the pair of conveying rotary members;

a vibration detecting sensor for detecting vibrations of one conveying rotary member of the pair of conveying rotary members; and a discriminating portion for discriminating a thickness of the sheet based on the vibrations detected by the vibration detecting sensor, wherein the discriminating portion discriminates the thickness of the sheet based on vibrations of the one conveying rotary member which are detected by the vibration detecting sensor when a rear end of the sheet passes through the pair of conveying rotary members, wherein the discriminating portion discriminates the thickness of the sheet based on a peak value of the vibrations when the rear end of the sheet passes through the pair of conveying rotary members, and wherein the discriminating portion discriminates the thickness of the sheet based on a difference of the peak value of the vibrations when the rear end of the sheet passes through the pair of conveying rotary members and a mean value of the vibrations after the sheet has passed through the pair of conveying rotary members.

2. A sheet discriminating apparatus according to claim 1, wherein the discriminating portion comprises amplitude detecting means for detecting an amplitude of vibrations of one conveying rotary member of the pair of conveying rotary members.

3. A sheet discriminating apparatus according to claim 2, wherein the discriminating portion determines that the sheet is a thick sheet when the peak value of the amplitude of vibrations detected by the amplitude detecting means is larger than a predetermined value, and determines that the sheet is a sheet thinner than the thick sheet when the peak value of the amplitude detected by the amplitude detecting means is equal to or smaller than the predetermined value.

4. A sheet discriminating apparatus according to claim 1, wherein the vibration detecting sensor is an acceleration sensor.

5. A sheet discriminating apparatus according to claim 1, wherein:

the pair of conveying rotary members are a pair of rollers which are designed such that one roller of the pair of the rollers can rotate while following another roller of the pair of the rollers, and when the sheets are sent in their stacked-up state, the one roller rotates in a direction opposite to a sheet conveying direction and the another roller rotates in the sheet conveying direction; and the vibration detecting sensor detects vibrations of the another roller.

6. A sheet discriminating apparatus according to claim 1, wherein the discriminating portion discriminates a thickness of the sheet based on vibrations of the one conveying rotary member of the pair of conveying rotary members which are detected by the vibration detecting sensor when a rear end of the sheet passes through the pair of conveying rotary members, and the discriminating portion detects that sheets are sent in their stacked-up state, based on vibrations of the one conveying rotary member of the pair of conveying rotary members which are detected by the vibration detecting sensor when the pair of conveying rotary members convey the sheets.

7. An image forming apparatus comprising:

a pair of conveying rotary members for conveying a sheet while rotating with the sheet sandwiched between the pair of conveying rotary members;

a vibration detecting sensor for detecting vibrations of one conveying rotary member of the pair of conveying rotary members;

an image forming portion for forming an image on the sheet conveyed by the pair of conveying rotary members; and a control portion for discriminating a thickness of the sheet based on the vibrations detected by the vibration detecting sensor when a rear end of the sheet passes through the pair of conveying rotary members and controlling the image forming portion to change an image forming condition of the image forming portion in accordance with the thickness of the sheet in which the discrimination has been made, wherein the control portion discriminates the thickness of the sheet based on a peak value of the vibrations when the rear end of the sheet passes through the pair of conveying rotary members, and wherein the control portion discriminates the thickness of the sheet based on a difference of the peak value of the vibrations when the rear end of the sheet passes through the pair of conveying rotary members and a mean value of the vibrations after the sheet has passed through the pair of conveying rotary members.

8. An image forming apparatus according to claim 7, further comprising a sheet stacking portion for having sheets stacked thereon, wherein the pair of conveying rotary members, whose vibrations are detected by the vibration detecting sensor, are a first pair of rotary members for conveying a sheet sent out from the sheet stacking portion with the sheet sandwiched therebetween.

* * * * *